US005766382A

United States Patent [19]

Hertzog et al.

[11] Patent Number: 5,766,382

[45] Date of Patent: Jun. 16, 1998

[54] THERMAL TREATMENT METHOD AND INSTALLATION FOR THE IMPLEMENTATION OF THIS METHOD

[75] Inventors: Jean-Marie Hertzog, Alle; Thierry Spérisen, Bienne; Michel Voutat, Orpund, all of Switzerland; Daniel Zimmermann, Roppentwziller, France

[73] Assignee: Patherm SA, Bienne, Switzerland

[21] Appl. No.: 635,258

[22] Filed: Apr. 12, 1996

[30] Foreign Application Priority Data

Apr. 13, 1996 [EP] European Pat. Off. ..... 95105618

[51] Int. Cl.[6] ..... C21D 6/00

[52] U.S. Cl. ..... 148/656; 266/252; 266/257; 266/261

[58] Field of Search ..... 266/252, 257, 266/261, 44; 148/633, 656, 626; 432/23, 18, 133

[56] References Cited

U.S. PATENT DOCUMENTS

| | | | |
|---|---|---|---|
| 3,852,026 | 12/1974 | Johansson | 432/23 |
| 3,882,596 | 5/1975 | Kendziora et al. | 228/200 |
| 5,456,773 | 10/1995 | Bittner et al. | 148/633 |

FOREIGN PATENT DOCUMENTS

| | | |
|---|---|---|
| 1 174 347 | 8/1959 | Germany . |
| 93 13 451 | 11/1993 | Germany . |
| 94/09164 | 4/1994 | WIPO . |

OTHER PUBLICATIONS

Harterei–Technische Mitteilungen, vol. 45, No. 6, Dec. 1990, Munchen, DE, pp. 325–329, J. Wunning "Die Warmebehandlung . . . " pp. 327–328; figures 7, 8*.

*Primary Examiner*—Scott Kastler

*Attorney, Agent, or Firm*—Griffin, Butler, Whisenhunt & Szipl

[57] ABSTRACT

A thermal treatment installation for treating and quenching pieces (22) of small dimensions comprises a treatment line (LT) including a treatment furnace (2) for bringing the pieces to treatment temperatures, a quenching cell (4) located downstream from the furnace, and a transport apparatus for displacing the pieces along the treatment line. The pieces to be treated are placed in baskets (20) and the baskets are grouped into charges or distinct lots forming a volume (V) having a height (H) substantially less than the other dimensions (L1, L2) of the volume. The transport apparatus comprises several driving devices (DE1, DE2, DE3, DE3' AND DE4) which are individually regulated by a regulation circuit (UC) to at least three speeds including an input speed (V1), a treatment speed (V2) and an output speed (V3) to divide the treatment line into sectors so that locally along the treatment line the baskets move at different speeds.

23 Claims, 6 Drawing Sheets

THERMAL TREATMENT METHOD AND INSTALLATION FOR THE IMPLEMENTATION OF THIS METHOD

FIELD OF THE INVENTION

The present invention concerns a method for thermally treating pieces, in particular of small dimensions, as well as an installation for the implementation of this method.

BACKGROUND OF THE INVENTION

Classic thermal treatment installations include one or several furnaces or ovens which are associated with at least one quenching cell or both, these elements cooperating with transport means enabling the displacement of the pieces to be treated between the furnace or furnaces and the cell.

The furnaces are maintained at relatively high heating temperatures, capable of ensuring the treatment of the pieces which must, to this effect, remain in the furnace a certain period of time enable to attain the desired treatment temperature.

As to the subsequent quenching, two main families exist, qualified respectively as gas quenching or hardening and liquid quenching, this referring to the environments used to ensure the rapid cooling of the pieces.

Gas quenching, such as it has been realized until now, is generally limited in its application to highly alloyed steels or said "autoquenchers".

On the other hand, normal steels, such as construction steels, carbonitruration steels or rolled steels must be quenched in a liquid environment, constituted for example by water, polymers, oil or melted salts, so as to obtain quenching speeds which are much higher.

Now, it has been noted that when the treated pieces are quenched in a liquid environment, they are submitted to an important thermal shock, and the cooling phenomena occurs in a non-homogenous manner, notably due to the appearance of calefaction sheaves caused by the boiling of a liquid. Furthermore, these sheaves appear at the surface of the quenched pieces, modifying the heat transfer coefficients between these pieces and the environment, which results in the deformation and distortion of the pieces, in particular if they are not very massive and if they have thinned shapes, as is generally the case of pieces having small dimensions.

It can thus be understood that quenching in a liquid environment is difficult to apply to the thermal treatment of small pieces, generally having complex shapes, whose geometric stability of either their shape or dimension, must be assured if one wishes to avoid subsequent working operations, such as machining.

Moreover, it should be noted that quenching in a liquid environment requires the performance of washing operations of the pieces after treatment, which considerably increases the treatment cost of each piece. Furthermore, antipollution standards impose the use of equipments for the cleansing of the washing baths and require the strict operation of limits as to the proportion and the nature of the rejected products, which, as will be understood, further complicates the exploitation of this type of quenching.

Liquid quenching thermal treatment installations which have been proposed up to now for the treatment of small pieces, are called "in-line" installations, that is to say in which the displacement of the pieces in the treatment furnace occurs in an essentially horizontal plane. In these installations, the quenching is carried out by dropping the pieces into the quenching bath, from the output of the furnace, under the effect of gravity.

An alternative to quenching in a liquid environment is also known, which is gas quenching or hardening, specifically applied to steels mediumly or slightly alloyed. This type of quenching is characterized by the use of gas pressure which may be greater than 15 bars. However, the use of high pressures can only be justified for the quenching of pieces having a very high added value or for very massive pieces, for example, tooling, this again being due to the cause of the high exploitation costs.

It will therefore be understood that there currently exists no technological and rational solution enabling the quenching of pieces of small dimensions, since all the solutions set out hereabove present inconveniences having as a consequence a realisation which is either incompatible, or too costly.

In fact, it can be noted that, for pieces of small dimensions, the application, by analogy, of conditions of quenching in a liquid environment to the conditions of gas quenching or hardening, cannot be done without an appropriate adaptation of the installations and processes since, notably in the case of in-line treatment, it is inconceivable with a gas quenching cell to allow the pieces to fall into the cell, from the output of the furnace, since the quenching environment is not able to break the fall of these pieces These pieces could thus be damaged or deformed, which would make this type of thermal treatment inapplicable Moreover, if one desires to conceive a method and a thermal in-line treating installation with a gas quenching cell for the treatment of pieces of small dimensions, one encounters the following obstacles.

In fact, the objective being to obtain a violent quenching, for application to all types of steels, the classic transport means turns out to be no longer adapted since they are the source of non-negligeable losses between the output of the furnace and the input of the quenching cell.

Obviously, one could increase the temperature present at the interior of the furnace by a corresponding amount, but this measure would have a consequence that the size of the grain of the material would be much too great, this alteration being known to seriously weaken the final mechanical properties of the piece or pieces treated.

Moreover, classic in-line treatment installations include one or several gastight locks or chambers at the input and the output of the furnace and at the input and the output of the cell.

Now, the operations of opening a gastight lock or chamber at the output of the furnace and of opening a gastight lock or chamber at the input of the quenching cell, during the transfer of the pieces, causes a cooling of the chamber of the furnace and consequently causes, once again, a lowering of the temperature of the furnace and the pieces contained therein.

In addition, the presence of gas in the quenching cell, either in a pure form or in a mixed form, introduces important risks of an explosion due to incompatibility between the two environments, respectively of the furnace and of the cell.

Thus, whilst one seeks, firstly, to avoid the putting into place of an overly heavy mechanisation in the construction of the closing locks or chambers, to enable the transfer of the pieces from the furnace to the cell without temperature loss in the transition zones, it can be noted that one must, on the other hand, avoid at all costs the interaction between the two environments, respectively of the furnace and the cell, firstly, so as to not cause the cooling of the furnace and, secondly, to reduce the risks of an explosion at the site of exploitation.

To this can be added the inherent inconveniences of gas quenching for which, as opposed to quenching in a liquid environment, the calorific exchange capacity is very small. This calorific capacity, which is nothing less than the capacity of the gas to absorb the heat contained in the pieces to be treated, holds an important place in the quality of the quench, since it is also this absorption characteristic which very importantly conditions the quenching speed.

For this reason, it must be recognized that the putting into place of classic thermal treating installations with gas quenching is not optimal in all conditions. Thus, for the pieces whose massiveness is elevated and for pieces made from steels which require cooling speeds such that gas quenching cannot confer to the quenched pieces the final hardness desired, it may be desirable to use an installation whose quenching is carried out in a liquid environment.

It has been determined that to increase this calorific capacity in the case of gas quenching, that is to say this thermal exchange, three conditions must be united, that is to say the presence of a cold gas prior to the quenching operation, a high gas flow and a turbulent regime of gas flux in the cell.

Now, if the pieces are presented in the form of a bed, the gas heats by traversing the bed of pieces, such that there exists, at the interior of this bed, levels of pieces which are submitted to different quenching conditions, that is to say which are in contact with a gas whose temperature has increased. Further, it can be noted that the presence of a turbulence at the heart of the bed of pieces cannot be maintained only at the first few levels.

To all this is added another condition in gas quenching installations, which is the stability of the controlled atmosphere at the interior of the furnace, so as to maintain a constant thermochemical treatment quality, for all types of treatment be it for austenitisation in nitrogen, austenitisation in synthetic gas, austenitisation under equilibre potential, salt nitriding, carbonitruration or again for nitrocarburation.

It is known that all of these types of thermochemical treatments require a draconian regulation of the treatment atmosphere. The quality of the thermochemical treatment is thus directly a function of the precision and of the stability of the characteristics of this atmosphere which cannot be submitted to important variations. Now, the transfer of pieces between the furnace and the exterior risks causing such perturbations.

Finally, it will be noted that the construction of a thermal treatment installation and the implementing of a specific process must meet the requirements of all industrial installations, that is to say technological simplicity, profitability, reliability, in particular for mechanically apparatus which are heated when functioning, security, and finally a fabrication and a maintenance presenting the smallest possible costs.

An object of the Summary of the Invention present invention is to supply an installation and a thermal treatment process which enables the treatment of small pieces, without limitation of their materials, and which avoids the problems of the obstacles mentioned above whilst responding to all the raised requirement demands.

To this effect, the invention concerns a thermal treatment method, of pieces notably of small dimensions, in a in-line treatment, including at least a furnace and a quenching cell, characterized in that it consists of:

arranging the pieces to be treated in individual charges in basket or trays, to constitute distinct lots forming a volume V of pieces, whose height H is chosen to be substantially less than the other dimensions of volume, introducing the individual charges into the furnace to bring the pieces to the temperature or temperatures of treatment, transporting the charges, firstly, into the interior of the furnace, and secondly, into the interior of the quenching cell, as well as between the furnace and the cell by transport means, and controlling the displacement of the charges on the transport means, along the processing line such that the charges are displaced along this line, locally, at different speeds.

The invention also concerns a thermal treatment installation for the implementation of this method, this installation being characterized in that it is intended to treat a group of trays or baskets adapted to receive the pieces to be treated and to regroup them in individual charges to constitute distinct lots forming a volume of pieces whose height is substantially less than the other dimensions of the volume, the transport means further being constituted by several driving devices which may be individually controlled by regulation means at at least three characteristic speeds respectively of input, of treatment and of output to divide the treatment line into sectors which assure locally, on this line, a displacement of the basket or trays at different speed levels.

Other characteristics and advantages of the invention will appear from reading the detailed description which follows, made in reference to the annexed drawings, which are provided solely as an example, and in which:

DESCRIPTION OF PREFERRED EMBODIMENTS

Figure 1:
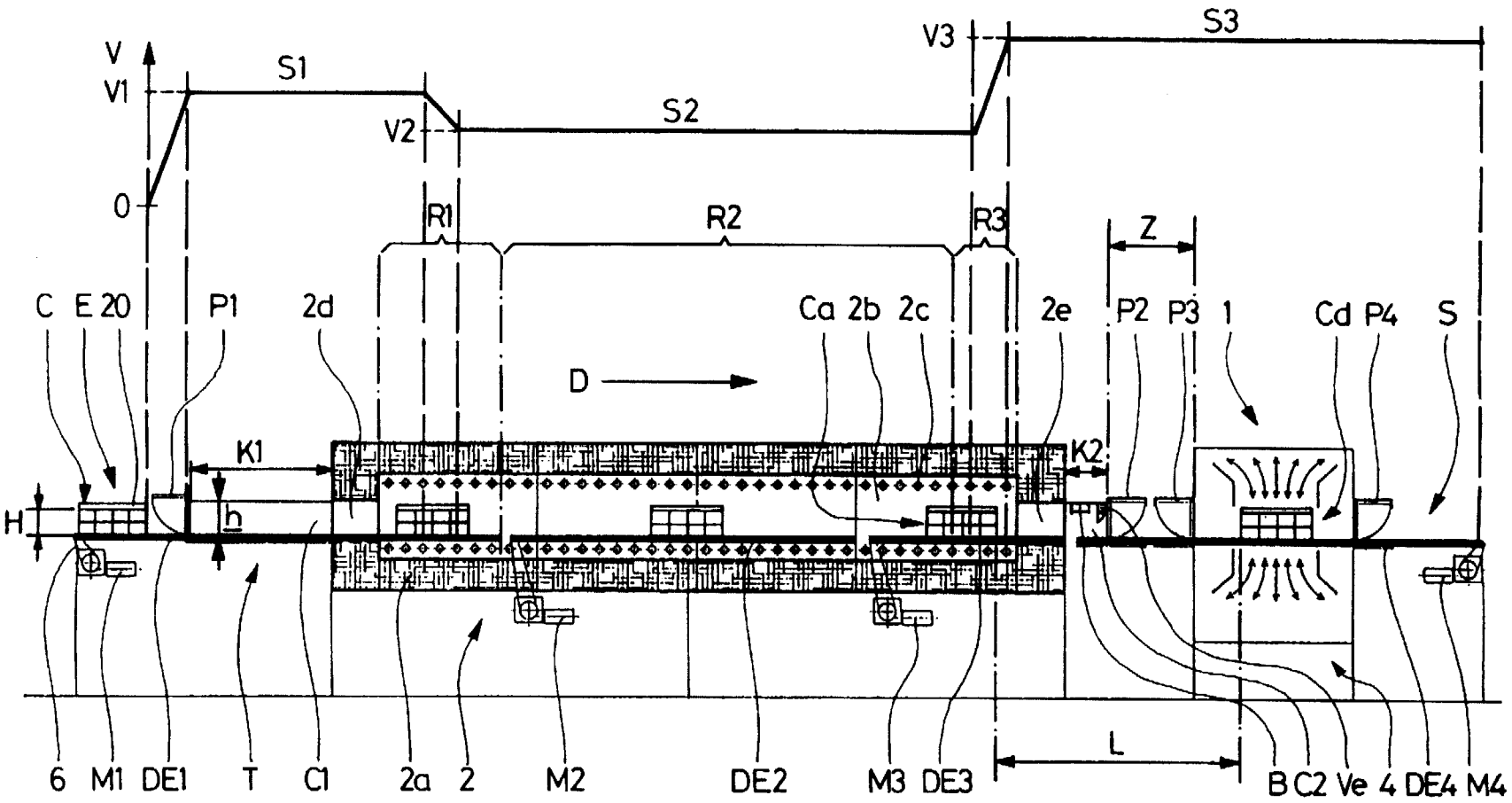
FIG. 1 is a side view of a thermal treatment installation according to a first embodiment of the invention, this installation being represented here in a very schematic manner with a diagram of the speed of displacement of the charges.
Figure 2:
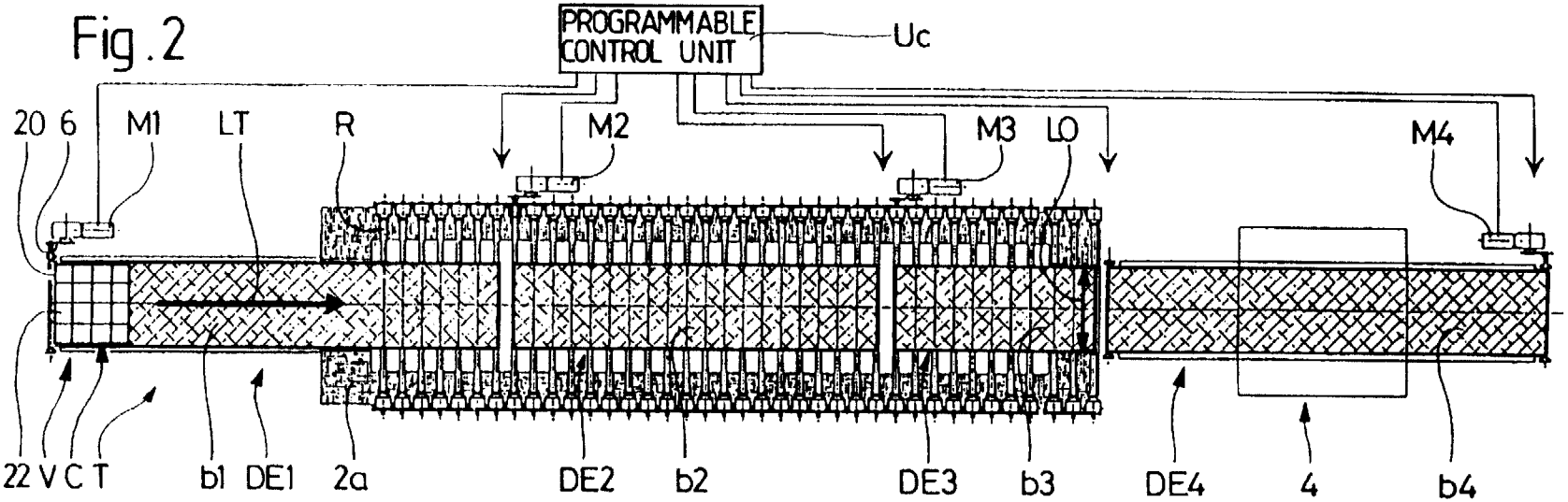
FIG. 2 is a longitudinal cross-sectional view of the installation of FIG. 1, essentially representing band driving devices of this installation.

Referring to FIGS. 1 and 2, there will be described hereafter a thermal treatment installation according to the invention according to a first embodiment.

This thermal treatment installation, which is shown by the general reference 1, includes in this embodiment, a furnace 2 in the longitudinal axis of which is located a gas quenching cell 4. Of course, the invention is not limited to an installation having only one furnace and only one cell, but also applies to installations having several furnaces and several cells, with chosen combinations of numbers of these two elements.

In this installation, the direction of displacement of pieces to be treated, which is carried out here from left to right, is represented by the arrow D. This displacement is made in an essentially linear manner and more particularly in the same horizontal geometric plan, by means of transport means T, which may be belts or roller.

The furnace 2 is constituted by a thermally insulating shell 2*a* which defines a treatment cavity or chamber at the interior of which is located a plurality of heating elements 2*c*, only one of which is referenced here.

The heating elements 2*c* are constituted, for example, by a group of electrical resistors able to heat the chamber 2*b* by convection and/or by radiation and to bring this chamber to chosen treatment temperatures. The resistors are connected in a classic manner to a programmable electric supply unit, non represented.

The treatment temperatures used are common, and are chosen within the classical ranges of temperature used in the thermal treating processes of metallic pieces.

The furnace 2 is open at the end of its two extremities by openings 2*d* and 2*e*, provided in the shell 2*a* and respectively forming an input opening and an output opening of the furnace 2. These openings present a width referenced LO (FIG. 2).

The chamber 2*b* includes three characteristic regions reference respectively R1, R2 and R3.

The first region, referenced R1, forms the input of the furnace 2. This region is located upstream with respect to the two others, the direction "upstream" and "downstream" being defined with reference to the displacement direction D of the pieces in the installation.

The second region, referenced R2, which is contiguous with the first region R1 and which is disposed downstream therefrom constitutes, in the chamber 2*b* of the furnace 2, the region having the greatest width. It is, in fact, this which is intended to ensure the heating of the pieces to be treated to the selected treatment temperatures.

Finally, the third characteristics region, referenced R3, which is contiguous with the second region R2, and which is similarly located downstream therefrom, is called output region since it is from this third region that the pieces being treated will be displaced towards the exterior of the furnace, to the gas quenching cell 4.

The installation 1 further includes an input E and an output S enabling the introduction and the return of the pieces. The input E and the output S are materialized in FIG. 1 by two extremities opening to the transport means T.

It will further be noted that the installation 1 includes a first input channel or tunnel C1, extending from the input E of the installation to the opening 2*d* of the furnace 2.

The installation 1 includes a second output channel or tunnel C2, extending from the opening of the output 2*e* of the furnace 2 to an intermediate zone Z provided between the output of the furnace 2 and the input of the cell 4.

The two channels or tunnels C1 and C2 are fixed in a gastight manner to the shell 2*e* of the furnace 2, and are thermally isolated and not heated. They communicate respectively with the regions R1 and R3 of the chamber 2*b* of the furnace 2.

The two channels C1 and C2 present respectively lengths K1 and K2. The length K2 is chosen to be at least equal to the width LO of the openings 2*d* and 2*e* (the representation shown in this figure not being to scale).

The channel C1 is provided at its input with a non gastight door P1, whilst the channel C2 is provided at its output with a non gastight door P2 of the same type.

It should be noted that the doors P1 and P2 may be controlled so as to open and close (here by pivoting) independently of each other.

At the level of the output door P2, installation 1 further includes means enabling the isolation of the atmosphere in the chamber of the furnace 2, with respect to the atmosphere of the quenching cell 4, these means being realised by the creation of a protection screen, not represented here, obtained, according to a first variant, by the combustion of the treatment gas and another gas. To this effect, there is provided at the level of the output door P2 of the furnace 2 a flame or pilot light Ve enabling the burning in a controlled manner of the treatment gas in this region.

The protection screen can also be obtained, according to a second variant by the establishment of an inert gas screen or curtain (not represented) projected by a nozzle B in the same zone.

The protection screen is formed when the door P2 is opened but also when it is closed, since this gate, being not gastight, leaves an open space by which the treatment gas may be inflammed by contact with air, by the flame or pilot light, if the gas is inflammable. If it is not inflammable, the over-pressure of the furnace 2 enables the creation of the gas screen.

During opening of the door P2, the protection screen ensures the gastightness between the furnace 2 and the ambient air and avoids the destabilisation of the atmosphere of the furnace 2. One therefore avoids that the gas of the furnace 2 is driven in the quenching cell 4.

It is also to be noted that the location of the channels C1 and C2, and the mounting of the non gastight doors P1 and P2 at the free extremity of these channels separate the source of potential perturbation of the atmosphere of the furnace 2, which improves the stability of the thermal chemical treatment characteristics in the chamber of the furnace 2.

It will also be noted that the putting into place of this arrangement is facilitated by the fact that the pieces are treated in charges in lots having a height smaller than the width, as will be explained hereafter in a detailed manner.

Similarly, the quenching cell 4 is provided at its input and at its output with two gastight or non gastight doors P3 and P4.

This quenching cell 4 includes a turbulence generator device, not represented, formed by a windbox or a helix. This speed and the flow rate of the gas are further assured by ventilators, similarly not represented.

The fluid used in this cell to assure the quenching operation is designated as being a gas, it will be noted that a disphasic environment can be used, that is to say a mixture formed of a gas and a liquid of another nature, in a pullverised form, in droplets.

The transport means T are formed (FIG. 2), for example, by a system of belts constituting several independent driving devices, here four, which are referenced respectively DE1, DE2, DE3 and DE4. These four independent devices are placed in the installation 1 so they are each in the extension of the other, close together, on the same level, and they form, in this installation, the plane of displacement of the pieces.

The first driving device DE1 which extends from the input E of the installation, to the first region of one of the furnace 2, through channel C1 and from the input opening 2*d* of the furnace, is intended to receive the pieces to be treated after they have been placed by a classical carrying device, non-represented here. This first driving device DE1 is also intended to ensure the rapid introduction of the lots of pieces to be treated above the door P1, and, the represented example, to the furnace 2, and more particularly to the first region R1.

The second driving device DE2 extends in the central region R2 of the chamber 2*b*, in the majority of this chamber, nevertheless leaving a sufficient space between the extremity of DE2 and the extremity of the region R3.

The third driving device DE3 extend from an end part of the region R2. It transverses the region R3 and penetrates in the output opening of the furnace referenced 2*e*, neighbouring the channel C2.

Finally, the fourth device DE4 extends, firstly, from the channel C2 to the output S of the installation, and, secondly, through the transition zone Z and the quenching cell 4 which it partly transverses.

As can be seen from FIG. 2, each driving device DE1 to DE4 includes, for example, a flexible conveyor belt, driven and rotatably supported by one or several driving rollers R, only one being referenced here.

The four driving devices DE1 to DE4, and more particularly their belts b1 to b4, as well as the furnace 2 and the quenching cell 4 form, by extending along a same longitudinal axis, a linear treatment line LT. The installation 1 according to the invention may thus be qualified as an in-line installation, the furnace 2 being a through-put furnace.

The rollers R which support the belts b1 to b4 are pivotably mounted in bearings (not represented), certain of which are fixed to the shell 2*a* of the furnace 2, the others being supported by classic support benches, not shown.

The belts b1, b2, b3 and b4 are respectively associated with independent motors M1, M2, M3 and M4.

The motors M1 to M4 are electric motors of a classical construction and consequently will not be described here in a more detailed manner. It will simply be noted that the driving between each motor and one of the rollers of the four driving devices DE1 to DE4 is made by mechanical means, such as, for example, by a chain 6 (only one being represented) engaged on two toothed wheels rotatably and movably attached respectively to the motor and to the corresponding motor roller assuring the driving of the belt.

The four motors M1 to M4 are all connected, for example, electrically to an electric control unit UC, constituted, in this example, by a programmable robot. Thus, these motors may be independently controlled at different rotation speeds to enable the operation of the four driving devices DE1 to DE4 at different speed levels, according to the chosen operating sequences.

Figure 3:
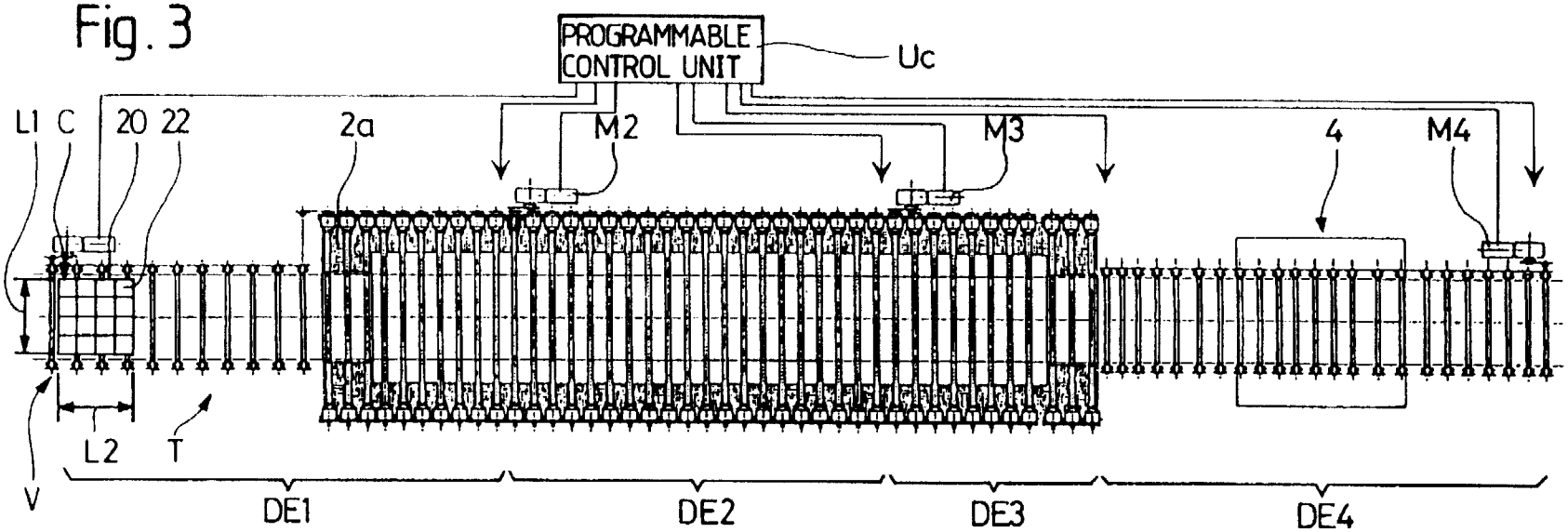
FIG. 3 is a view similar to that of FIG. 2 but representing driving devices formed from groups of rollers.
Figure 4:
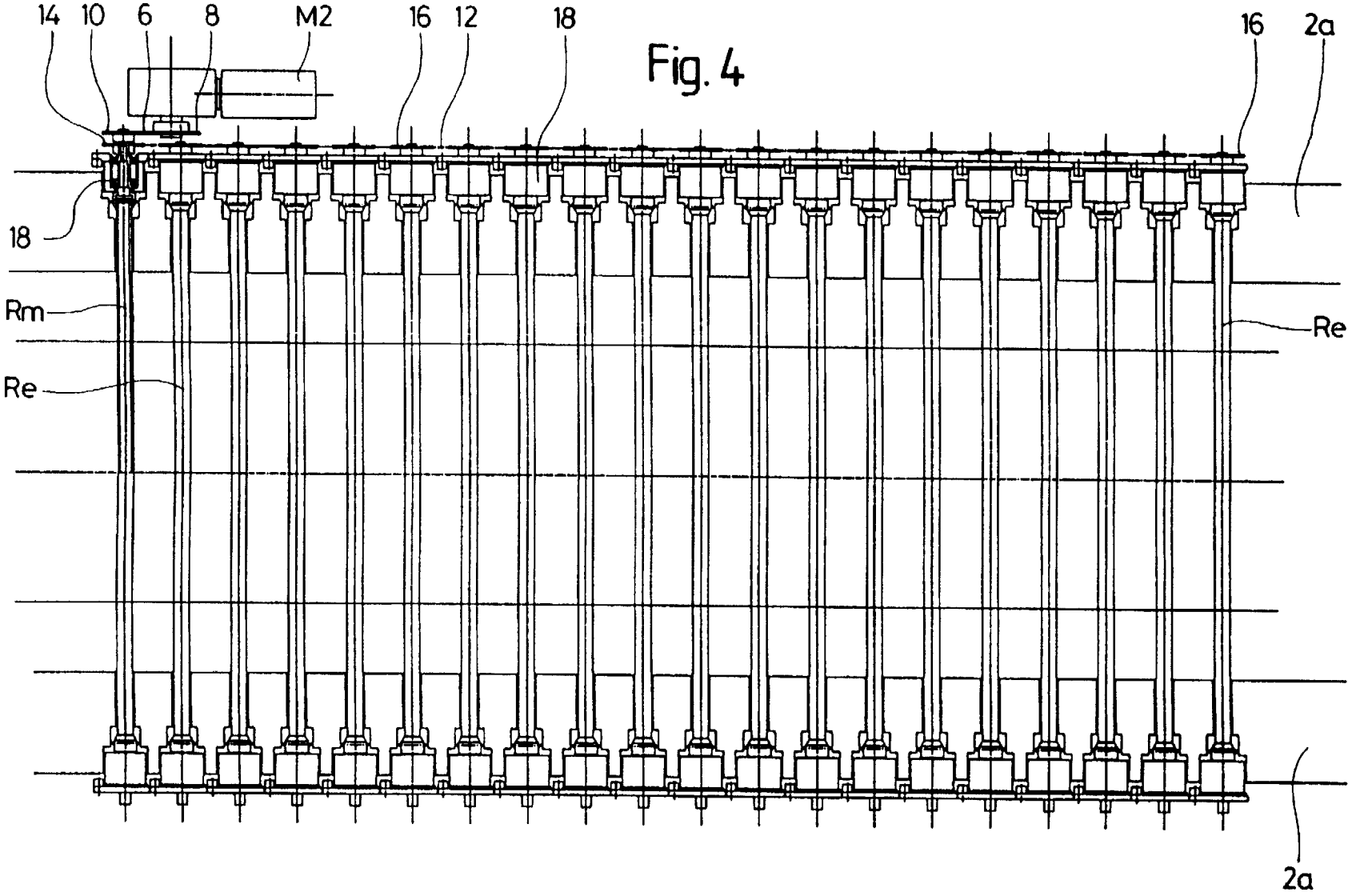
FIG. 4 is a plan view of one of the group of rollers of FIG. 3.

Referring now to FIGS. 3 and 4, there will be described hereafter a thermal treatment installation with driving devices having solely rollers.

This installation only differs only from the different installations represented at FIG. 2 by the absence of the flexible conveyor belts, the four driving devices DE1 to DE4 being here constituted by groups of driving rollers, rollers whose structure is of a similar type as that of the rollers equipping the driving devices of FIG. 2.

In each group of driving rollers, a motor roller RM (FIG. 4) is mechanically connected, as in the preceding embodiment, to the one of the motors M1 or M4, by means of two pinions 8 and 10, fixedly interconnected respectively to the motor and the motor rollers, and by means of a chain 6 guided to these two pinions. In each group of rollers the motor roller Rm is connected to the other group of rollers Re (two being referenced) by a transmission train 12 meshing, firstly, with a second pinion 14 rotatably fixedly interconnected with the motor roller Rm, and secondly, with pinions 16 (two being referenced) fixed respectively to one extremity of the driven rollers Re to supply them with a synchronous rotational movement.

Certain of these rollers, as is the case of the rollers of the driving device DE2, which is represented in detail on FIG. 4, are rotatably mounted in bearings 18 (two being referenced), for example ball bearings, fixedly engaged in the shell 2*a* of the furnace 2, and notably in its lateral walls, non referenced.

The other rollers of the devices DE1 to DE4, which are not supported in the shell 2*a* of the furnace 2, are freely rotatably mounted in plastic support benches, not represented.

Referring now to FIGS. 1 and 2, it will be described hereafter in a more detailed manner the advantageous disposition of the pieces to be treated, at the interior of the installation.

In fact, the installation is further characterized in that there is provided in its dimensions and in its operating mode for treating a group of trays or baskets 20 which are adapted to receive the pieces to be treated 22 (only one being referenced) and to regroup them in individual charges C. The pieces 22 are represented in FIGS. 1, 2 and 3 in a very schematic manner by symbols having a square form but it is of course intended that small pieces of any form may be treated by the installation and the method according to the invention.

More particularly, according to this method, there is disposed, in a first step, the pieces to be treated 22 in individual charges C, in trays or baskets 22, to constitute distinct lots which form a volume V of pieces whose height H is advantageously chosen to be substantially less than the other dimensions of the volume.

Other dimensions of the volume V are given here (FIGS. 1 and 3) by the size of the sides of this volume, sizes respectively referenced L1 (width) and L2 (length). For example, one can choose an height H at least twice as small as the sizes L1 and L2. In one embodiment, the height H is equal to approximately to 200 mm, whilst the width L1 and the length L2 are each equal to approximately 400 mm to 800 mm.

This particular dimensioning of the volume of charges enables all the pieces of a charge to be transversed, during the subsequent quenching by a flux of gas, a diphasic mixture or by a liquid, whose characteristics do not vary or only very slightly for different levels of pieces at the heart of the charge.

It will further be noted that the output and the input of the furnace, that is to say the input and output openings 2*d* and 2*e* of the shell 2, and, in this example, the exterior openings leading into channels C1 and C2, present a height h in the order of the height of the lots of pieces, plus the space necessary for the passage of the conveying belts and the introduction of the baskets in the openings.

Next, after having placed the pieces to be treated in charges C, each charge C is placed at the input E of the installation, at the extremity of the first driving device DE1.

After opening the door P1, the driving device DE1 is operated to enable the charge C thus dimensioned and put into place to be introduced rapidly into the furnace 2 and until the first region R1.

The charge C thus passes the door P1, then passes through the channel C1 and the input opening 2*d* of the shell 2*e* at a first speed level V1, for example in the order of 250 to 400 cm/min. Then the gate P1 is closed to minimize the contamination of the atmosphere of the furnace and to limit the gas consumption.

It will be noted here that the length of the belt b1 is not represented to scale in FIGS. 1 and 2 since it must enable the charge C to be sufficiently accelerated to obtain these introduction speed V1. The method or process has been illustrated with a constant acceleration of charge, leading to a linear increase of its speed, but another form of acceleration may be chosen. In addition, this speed V1 can also not be constant. It can vary around the value V1, if the device DE1 is submitted between the input E and the region R1 to accelerations or decelerations. This is the reason why it is referred to here as "levels" of speed. This remark applies in a general manner to the behaviour of the other characteristic speeds of the installation, referenced V2 and V3.

When the charge C arrives in the first part of the region R1, its speed is reduced by slowing the motor M1, so the charge C which is still on the first driving device DE1 attains a speed level V2 less than the level V1. This second speed characteristic level is, for example, equal to between approximately 50 to 100 cm/min.

At the same time, the second driving device DE2 is controlled, so that it attains the speed V2 via an appropriate supply from the motor M2, controlled by the central control unit UC. The charge C will thus be displaced at the speed V2 but now by the second driving device D2 through the length of the belt b2.

When the charge approaches the third device DE3, this latter is controlled via its motor M3, so that it also attains the speed level V2 and so that it can receive the charge C.

The charge C is thus displaced in all the region R2 of the furnace 2, at the speed level V2, speed at which the charge C of pieces 22 is submitted to the chosen treatment temperature.

When the charge C arrives in the output region R3, the third driving device DE3 is operated via an appropriate control from the motor M3, so that it strongly accelerates the belt b3 and the charge C, and so that this charge C has a speed level V3, at least greater than the level V2, and, in this example, also greater than the level V1. The speed level V3 which acts to rapidly extract the charges is chosen in this example to be between approximatively 500 to 800 cm/min.

Simultaneously, the output door P2 is opened and the input door P3 of the quenching cell is opened.

In addition, the forth driving device DE4 is brought to a speed level V3 via a control of its motor M4, in order to assure the rapid transfer of the charge C between the furnace 2 and the quenching cell 4, through the channel C2 and the doors P2 and P3.

It will thus be understood that the control of the motors M1 to M4 at specific speeds enabling the speed levels V1 to V3 to be obtained, is controlled by the central control unit UC which constitutes in these installation means for controlling the speed of the driving devices DE1 to DE4, so as to attain the different speed level V1 to V3.

As can be seen in FIG. 1, the displacement of the charges C is regulated along the treatment line LT, by an appropriate regulation of the two driving devices DE3 and DE4 by control from the central control unit UC, so that there is created between this latter charge (referenced Cd), located in the quenching cell and the upstream charge (referenced Ca) present in the furnace, in the output region R3, a distance L, able to ensure the stability of the temperature of the pieces 22 and the stability of the thermochemical characteristics present in the chamber 2*b* of the furnace 2. This distance is typically equal to two to four times the length L2 of a charge.

Thanks to this disposition, a lot of pieces can be quenched without influencing the treatment of the lot or lots upstream.

Figure 5:
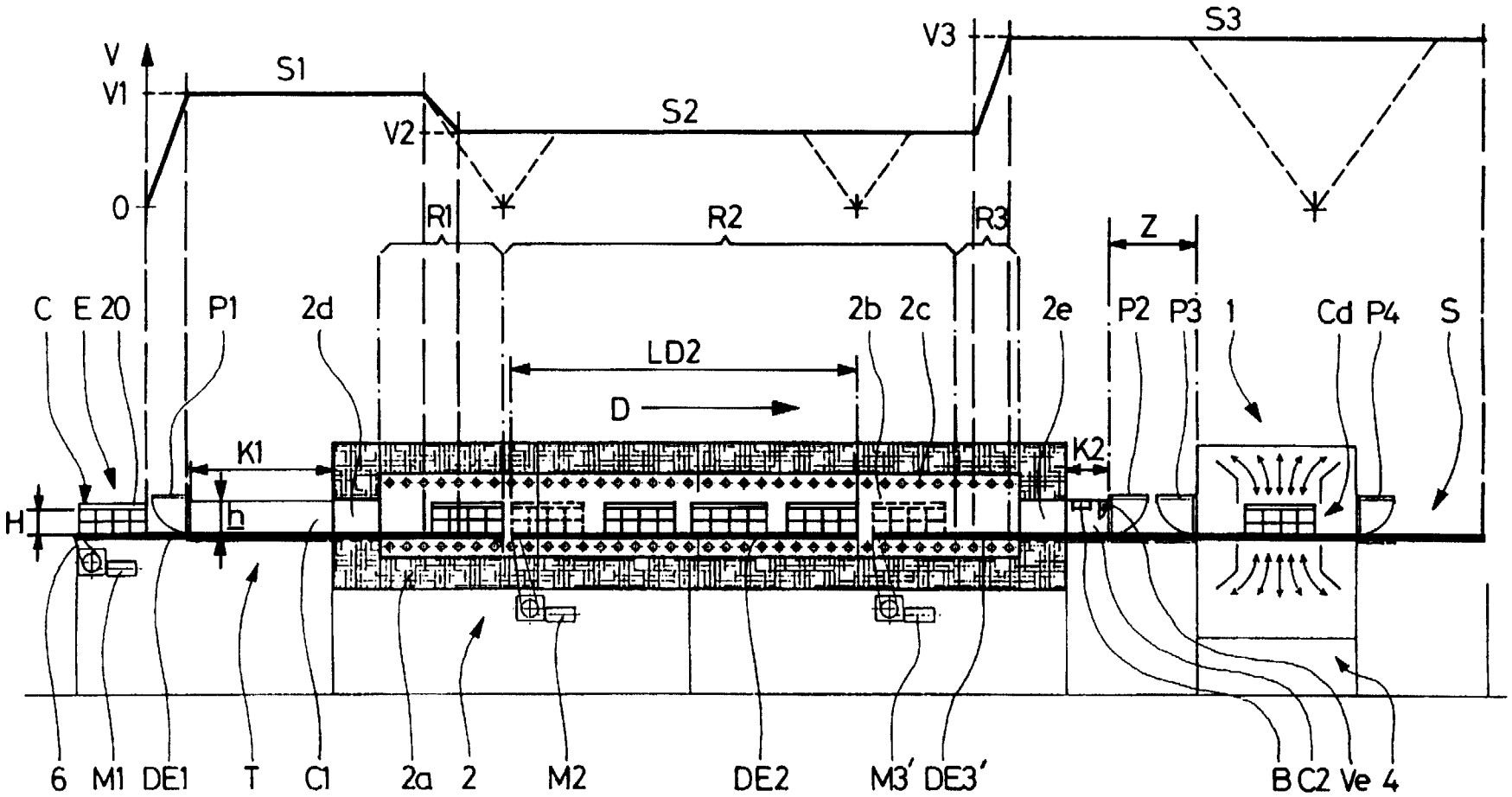
FIG. 5 is a view similar to that of FIG. 1, but representing a second embodiment installation according to the invention providing solely with three driving devices.
Figure 6:
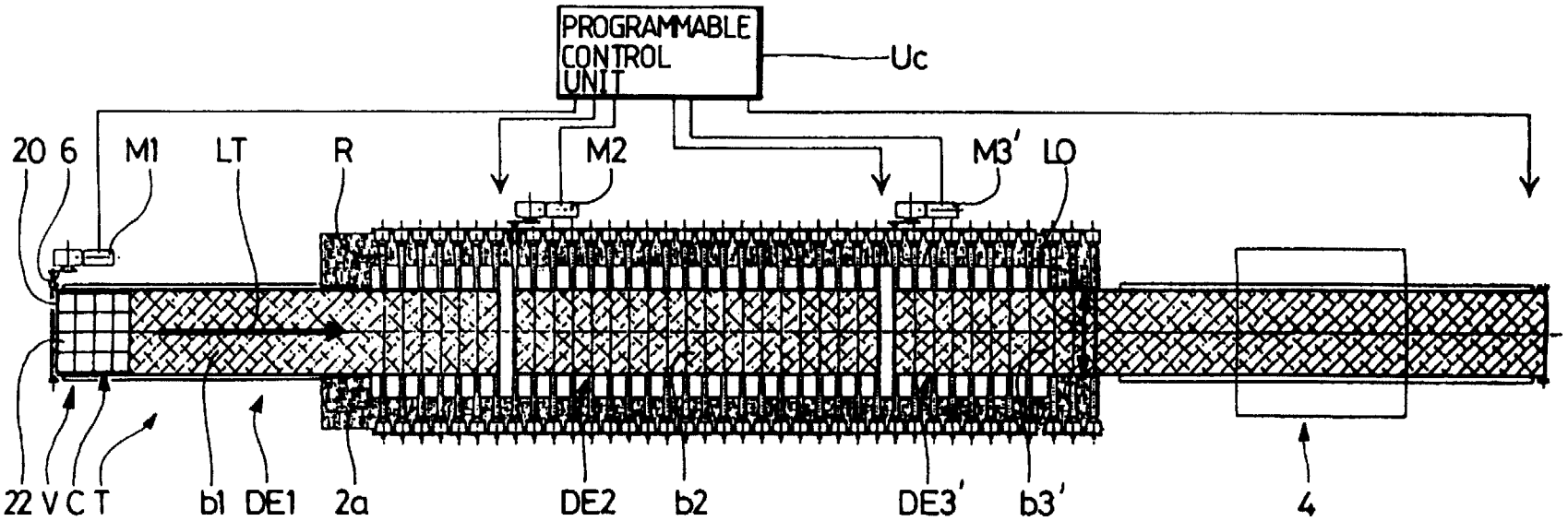
FIG. 6 is a cross-sectional view similar to that of FIG. 2, but representing the installation according to the second embodiment.

Referring at FIGS. 5 and 6, there will be described hereafter an installation according to a second embodiment.

The installation represented in these figures differs from the installation previously described only in that the transport means T no longer include four, but three driving devices DE1, DE2 and DE3'. The first two driving devices DE1 and DE2 as well as the other components of this installation are identical to those described hereabove.

The driving device DE3', which is similarly driven by the central control unit UC via the motor M3', extends, as do the two devices DE3 and DE4 of the first embodiment which it replaces, from the end part of the region R2 and then transverses the region R3, the output opening of the furnace 2*e*, the output channel C2 and the transition zone Z to attain the quenching cell 4. In the represented example, the driving device DE3' also transverses the quenching cell 4 and opens into the output S.

This second installation operates according to the identical and similar sequences S1, S2 and S3 and at the same speed levels V1, V2 and V3.

However, after the lot of pieces has passed the door P1 and has been brought to the speed V1 to the extremity of the first device DE1, the three driving devices DE1 to DE3' are simultaneously driven at the same speed V2, during a time T, to enable the newly introduced charge, located on the device DE1, to come to be placed completely on the device DE2 (as represented in dotted lines) and to enable this latter charge, which has initially been positioned at the extremity of the second device DE2, to also come to be placed completely on the following device DE3' (as also represented in the dotted lines). This operation is carried out without any of the doors P1 and P2 being required to be opened.

The displacement of the lots of charges C to the extremity of the two devices DE1 and DE2 is obtained by the regulation of the control unit UC which orders the acceleration, the deceleration and eventually the stop of the motors M1 to M3' as a consequence.

Finally, when the charge is found on the third device DE3', the doors P2 and P3 are thus opened and the device DE3' is brought to the speed V3 so the charge is rapidly transported to the quenching cell 4. The gate P2 is immediately closed as soon as the charge leaves the channel C2 and the door P3 is closed when the charge C is entirely in the quenching cell 4.

It will be noted that in this embodiment of the invention, the second driving device DE2 includes a length LD2 which is a multiple of the length L2 of the charges, within the gap left between the charges.

As in the first embodiment, the installation operates according to three characteristics sequences with a rapid introduction speed V1, a slower treatment speed V2 (V1>V2) and a very rapid output speed V3 towards the quenching cell which is at least greater than V2 (V3>V2) and which may also be greater than V1 (V3>V1>V2).

Although it will not be described here, it will be noted that the installation according to the invention may also be provided with mechanical stops or abutments lodged at least partly in the chamber 2*b* of the furnace 2 and being able to be controlled from the exterior, for example by the control unit UC, so as to come into position at the extremity, for example of the two first driving devices DE1 and DE2 or at the extremity of the three devices DE1 to DE3' so as to ensure the stopping of the charges at the end of the devices in a defined position on the treatment line LT. One such stop may be constituted for example by a bracket or lug pivotably mounted or by a linearly displaced pin operated by a chuck and enable to project to the extremity of the belts b1, b2 and eventually b3' or between two rollers.

It will be understood that in this particular control mode, the lots of charges C are stopped at the extremity of the driving devices and that these lots have a zero speed (V=0) at the end of each sequence S1, S2 and S3 (the speed variations with this type of control have been represented, with respect to the continuous control mode, by dotted lines). To avoid the rubbing of the basket on the belts or rollers, the movement of the driving devices associated with these mobile stops is preferably stopped by an appropriate control from the control unit UC, when the stops act on the corresponding charges.

Figure 7:
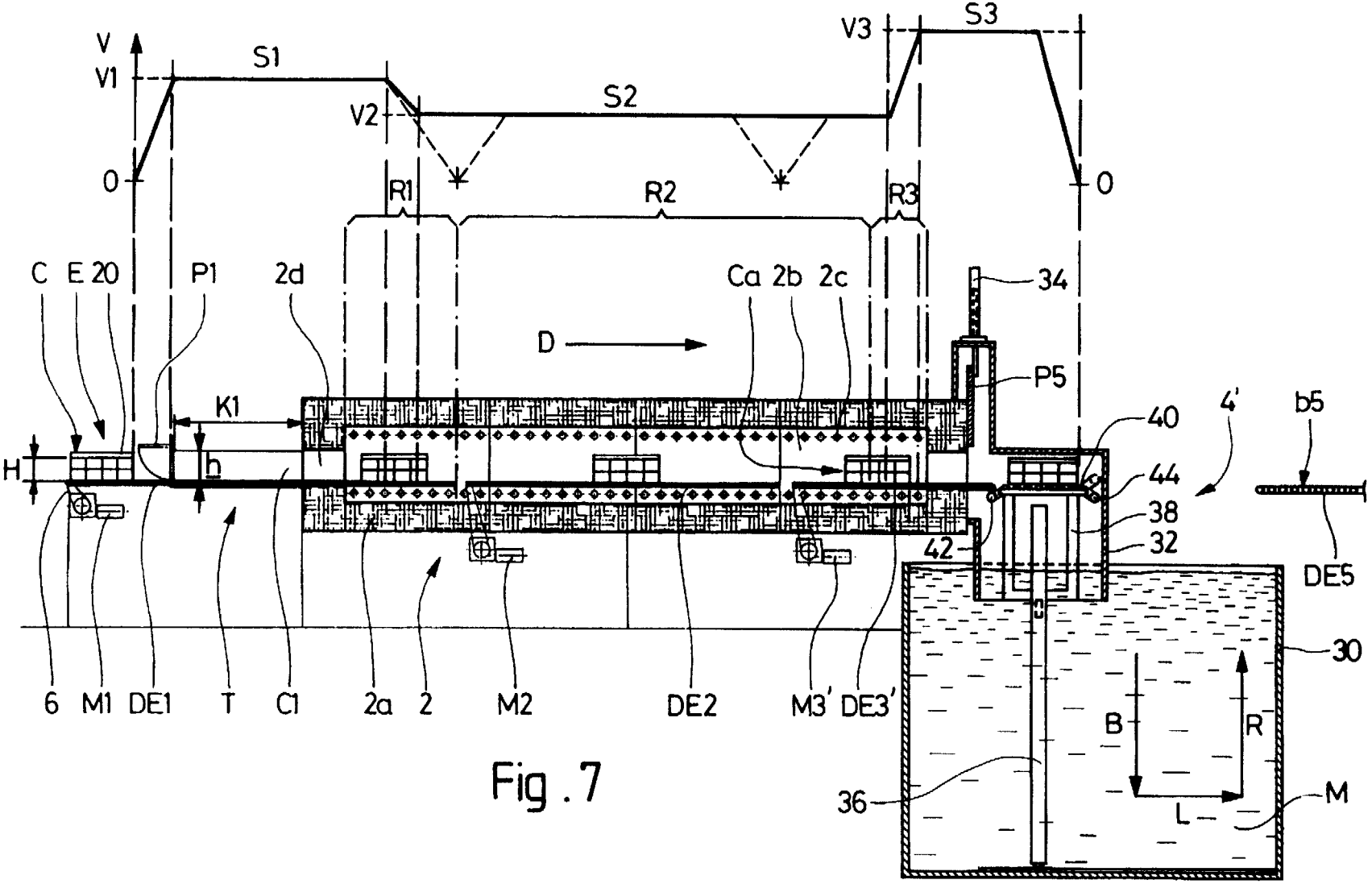
FIG. 7 is side view of an installation of third embodiment of the invention showing an application of the quenching in a liquid environment.

As can be seen in FIG. 7, the treatment of the charges of small pieces described in conjunction with the above described sequences also applies to the quenching in a liquid environment.

The installation represented in FIG. 7 includes a quenching cell 4' which includes a vessel or container 30 containing a liquid environment M such as water, a mixture of polymers, oil or dissolved salts. The vessel 30 is partly positioned under a gastight transfer lock or chamber 32 which is fixedly interconnected to the shell 2*a* and which is emerged in the environment M.

This lock or chamber 32 includes a door P5 which may be operated by a jack 34.

Inside the vessel 30 is housed a lift 36 which includes a support 38 able to receive the charge at the extremity of the third driving device DE3'.

On this support 38 are placed rollers 40 interconnected by a chain or any other driving means, not shown. The rollers 40 may be located in the plan of the last driving device DE3' and are associated on a first side to a wheel or a driving roller 42 intended to come into contact either with another wheel, or with a roller or the free extremity of the belt, to be rotatbly driven by the driving device DE3'. This wheel or driving roller 42 being connected by a chain or any other means to the rollers 40 assures the rotational driving of the rollers 40 when the support 32 is in a high as represented in FIG. 7.

When a charge C is placed on the support 38, the lift or elevator 36 loads the support 38 and the charge C in the versel 30 to ensure the quenching (arrow B on the figure). The lift then laterally displaced towards the right (arrow L) when it once again raises the support 38 and the charge C to free air (arrow R) so that the charge C can be retaken, either by a lifting apparatus, or by and exterior driving device DE5 also formed by a group of rollers or a belt b5, in a case where the charge is retaken at its output by a group of rollers or a belt b5, a second wheel 44, opposed to the first referenced wheel 42 may be provided on the other side of the support 38 to come into contact with this belt and to ensure the driving of the rollers 40 of the support 38 in order to enable the freeing of the charge on the belt b5 (towards the right on the figure).

In this example, the lift 36 is thus part of the transport means T of the charges C in the installation, the treatment line LT extending in several orthogonal directions.

Retractable mechanical stops or abutments, not represented, may be provided on each side of the support 38 to ensure to precise positioning of the charge on the support.

The stops may be constituted for example by vertical plates which are, firstly, mounted on each side of the support 38 on compression springs which maintain them in a high position and which are, secondly, associated with control means, such as a pin or an orthogonal plate, being able to bear against the rollers or the belt of the driving devices DE3' and DE5, during the rising movements of the lift 36, in order to control the lowering of the corresponding stop plate and enabling the passage of the charge.

These stops may, according to another embodiment, be constituted by elements which support the wheels 42 and 44 on either side of the support 38 if these elements are rotatably mounted on the support and may be liberated by the action of a resilient element when the wheels 42 and 44 are not in contact with the driving devices DE3' and DE5, as represented by dotted lines in FIG. 7, to the right of the support 38.

It will be noted that in this application of quenching in a liquid environment, the arrangement of the pieces to be treated in the charges whose dimensions are such that the height H of this charge is chosen to be substantially greater than the other dimensions of the volume, enables, as for gas quenching, to not require the flux to transverse too greater a height in the aim of obtaining homogeneous quenching conditions for the pieces situated upstream and downstream with respect to the direction of circulation of the liquid by avoiding an elevation of temperature of the quenching liquid at the passage between the two levels.

Furthermore, it will be noted that the constitution of the charges in lots offers an interesting alternative in the case of quenching in a liquid environment, which is traditionally effectuated by the dropping of pieces in the quenching environment. In fact, the pieces dropping into the quenching environment and the effective gravity cause shocks to each other and damage each other, all the more as they are previously brought to temperature at which the pieces no longer have mechanical resistance, nor sufficient hardness to enable them to accommodate the shocks by resilient deformation.

In addition, the fact of constituting the pieces in charges and transporting the pieces thus through the furnace enables the recuperation of the charges on the lift so as to introduce them into the quenching environment by a vertical movement of orthogonal descent to the linear displacement in the furnace, at a same predetermined speed for all the pieces.

The liquid quenching environment can be agitated in a conventional manner by imposing upon the fluid a movement in the opposite direction to that of the charge.

This characteristic advantageously enables the limitation of the deformation of the pieces and enables the avoidance of all risk of damage to the pieces during the introduction into the quenching environment.

It will be noted here in the detailed description in which is made of the method according to the invention, that reference is made to a charge but only as a function of an appropriate dimensioning of the transport means T, of the furnace 2 and the cell 4. One could obviously place next to each other several charges C (that is to say several baskets) which would simultaneously be submitted to the same displacements at three characteristics speed levels V1, v2 and V3 and which would be displaced in parallel in a concomitant manner from the input E of the installation 1 to the output S.

It will thus be understood from what has just been described that a process has been realised, in which, after having introduced each individual charge in the furnace 2 to bring the pieces to be treated to the temperature or the temperatures of treatment, the charge or charges C are transported, firstly, to the interior of the furnace 2, and secondly, to the interior of the quenching cell 4, as well as between the furnace 2 and the cell 4 by means of the transport means T constituted by the displacement devices DE1 to DE4, by regulating the displacement of these charges C on the transport means T, along the treatment line LT, such that the charges C are displaced along this line, locally, at different speeds V1, V2 and v3.

In this in-line thermal treatment installation having a through-put furnace, there has thus been provided driving devices DE1 to DE4 which may be individually regulated at different characteristic speeds to divide the treatment line LT into sectors S1, S2 and S3 (FIG. 1) assuring locally on this line LT, a displacement at discontinuous spaces of trays or baskets forming the content of the charges C, at different speed levels V1 to V3.

Furthermore, this installation comprises regulation means formed by the control unit UC associated with the driving devices DE1 to DE4 to regulate them at the speed levels such that the lots of the pieces enter and leave the furnace at speeds higher than the speed level V2 at which the lots are displaced in the furnace, during the treatment.

Thus the transfer time of the lots of pieces is reduced, during the introduction in the furnace, but also during the extraction, for the introduction in the quenching cell.

Furthermore, the treatment in lots of small pieces and the division of the transport means into several driving devices, along the treatment line, enables the dissociation of the operation of introduction of the lots in the furnace and the extraction of the lots from the furnace, such that only one of the doors P1 or P2 needs to be opened. One thus limits again the risk of perturbing the atmosphere of the furnace. One has therefore in this process and this installation dissociated the operations of feeding of the furnace, of advancing into the furnace and of leaving the furnace, by thus accelerating locally the transfer of the charges.

It will also be noted that in the installation and the process according to the invention, the control unit UC regulates the driving devices and their motor such as the adjacent extremities of these devices are driven at a same speed during the transfer of each charge of a device on another in order that the trays of charge C pass from the preceding device to the following device without excessive slipping between their bottoms and, for example, the two belts which support them during the overlapping of the bottom of these trays and the adjacent bands.

This guiding of the driving devices at a same pace at a given period, that is to say at a same speed level or according to a same acceleration after a stop of the charges, enables the transfer of the charges from one device to another without speed variation between the baskets which transport the charges and the belts or weels which drive them.

It will be noted here that there has been described that the installation and a process in which each charge is displaced along the treatment line LT according to at least three types of characteristics displacements, that is to say fast, slow, and quicker, the invention not being limited to these three regimes but being able to comprise a greater number of speed levels, in association with a number of driving devices greater than four.

In addition, the types of driving and their sequences at the speed levels V1 to V3, those being described in the reference of the embodiment of FIG. 2, also apply to the driving of the groups of rollers represented in FIGS. 3 and 4.

We claim:

1. A method for the thermal treatment of pieces of small dimensions, on a treatment line (LT) including at least one furnace (2) and a quenching cell (4), said method comprising:

arranging the pieces to be treated (22) in individual charges C, in trays or baskets (20), to constitute distinct lots of pieces forming a volume V of pieces whose height H is substantially less than the other dimensions (L1, L2) of the volume, introducing the individual charges (C) in the furnace (2) to bring the said pieces to the temperature or temperatures of treatment, transporting the charges (C), firstly, to the interior of the furnace (2), and secondly, to the interior of the quenching cell (4), as well as between the furnace and the quenching cell by means of a transport means (T), regulating the displacement of the charges (C) on the transport means (T), along the treatment line (LT) such that the charges (C) are displaced along said treatment line, locally, at different speed levels (V1, V2 and V3), and, controlling the displacement of the charges (C), along the treatment line (LT), to create, between a last charge (Cd) located in the quenching cell (4) and a charge upstream (Ca) present in the furnace (2), a distance L, to ensure the stability of the temperature of the pieces and the stability of treatment conditions present in the furnace.

2. A method according to claim 1, wherein:

each charge (C) is displaced along the treatment line (LT), according to at least three different speed levels V1, V2 and V3.

3. A method according to claim 2, wherein:

the charge or charges (C) are displaced from the exterior of the furnace (2) to a first region interior of said furnace (R1), called the input region, at a first speed level V1 to ensure the rapid introduction of the charges into the furnace, the charge or charges (C) located in a second region (R2) of the furnace, called the central region, disposed downstream from the first region (R1), are displaced at a second speed level V2, less than the speed level V1, the speed level V2 being chosen to ensure the application of the treatment to the charge or charges in the furnace, and the charge or charges (C) are displaced from a third region of the furnace (R3) called the output, located downstream from the second region, to the interior of the quenching cell, at a third speed level V3, greater than the speed level V2, the third speed level V3 being chosen to ensure the rapid transfer of the charge or charges (C) between the furnace (2) and the quenching cell (4).

4. A method according to claim 1, and further comprising the steps of:

closing at least the output of the furnace (2) by a non gastight closing door (P2) and insulating the atmosphere of the furnace (2) from the atmosphere of the quenching cell (4) by creating a protection screen at the output of the furnace (2), at least when the said door (P2) is opened.

5. A method according to claim 1, and further comprising the steps of:

passing the charges (C), immediately before their input into the furnace (2), through a first non heated thermally isolated channel (C1), communicating with the furnace (2), and passing the charges (C) immediately at an output of the furnace (2), through a second non heated isolated channel (C2), also communicating with the furnace (2).

6. An installation for the implementation of a method for thermal treatment of pieces of small dimensions, said installation including, at least one treatment furnace (2) for bringing the pieces to be treated (22) to treatment temperatures, at least one quenching cell (4) located downstream from the furnace (2), the furnace and quenching cell forming a treatment line (LT), and transport means (T) for displacing the pieces (22) along the treatment line (LT), the installation further including a group of trays or baskets (20) for receiving the pieces to be treated (22) into groups in individual charges to constitute distinct lots of pieces forming a volume V of pieces whose height H is substantially less than the other dimensions (L1, L2) of the volume, said transport means (T) being further constituted by several driving devices (DE1, DE2, DE3, DE3, and DE4) which are individually regulated by a regulation means (UC), at at least three different speed levels including an input speed level (V1), a treatment speed level (V2) and an output speed level (V3) to divide the treatment line (LT) into sectors (S1, S2 and S3) ensuring locally, on the treatment line, a displacement of the lots of pieces at different speed levels (V1, V2 and V3), said regulation means (UC) being provided for guiding the driving devices at speed levels (V1, V2 and V3) which are chosen so that the lots of pieces enter and leave the furnace at speed levels (V1, V3) greater than the speed level (V2) at which said lots of pieces are displaced in the furnace, during the treatment.

7. An installation according to claim 6, comprising four driving devices (DE1 to DE4).

8. An installation according to claim 7, wherein the four driving devices comprise:

a first driving device (DE1) extending from an input (E) of the installation, upstream from an input gate (P1) of the furnace (2) and above the input gate (P1) to enable the passage of lots of pieces (C) beyond the gate (P11) at a speed level (V1), a second driving device (DE2) located downstream from the first driving device and extending at least to the interior of the furnace (2), the second driving device (DE2) enabling the treatment of the lots of pieces (C) at a speed level (V2), less than the speed level (V1), a third driving device (DE3) disposed downstream from the second driving device and extending from the interior of the furnace to near a channel (C2) subject to the furnace (2), the third driving device (DE3) enabling the passage of the displacement speed of the lots of pieces from the speed level (V2) to a speed level (V3) greater than the speed level (V2), and a fourth driving device (DE4) disposed downstream from the third driving device and extending from the interior of the channel (C2) at least to the interior of the quenching cell (4), the fourth driving device (DE4) enabling the output of the lots of pieces from the furnace and their rapid introduction into the quenching cell (4) at the speed level (V3).

9. An installation according to claim 6, having at least three driving devices (DE1, DE2 and DE3') including:

a first driving device (DE1) extending from an input (E) of the installation, upstream from an input gate (P1) of the furnace (2) and beyond the input gate (P1) to enable the passage of lots of pieces beyond the gate (P1) at a speed level (V1), a second driving device (DE2) disposed downstream from the first driving device and extending at least to the interior of the furnace (2), the second driving device (DE2) enabling the treatment of lots of pieces (C) at a speed level (V2), less than the speed level (V1), and a third driving device (DE3',) located downstream from the second driving device and extending to at least the interior of the quenching cell (4), the third driving device enabling the output of the lots of pieces from the furnace and their rapid introduction into the quenching cell (4) at a speed level (V3) greater than the speed level (V2).

10. An installation according to claim 6, including two non heated thermally isolated channels (C1 and C2), located respectively between an input gate (P1) of the furnace and an input thereof (2*d*) and between the output (2*c*) of the furnace and an output gate of the furnace (P2).

11. A method for the thermal treatment of pieces of small dimensions, on a treatment line (LT) including at least one furnace (2) and a quenching cell (4), said method comprising:

arranging the pieces to be treated (22) in individual charges C, in trays or baskets (20), to constitute distinct lots of pieces forming a volume V whose height H is substantially less than the other dimensions (L1, L2) of the volume, introducing the lots of pieces into the furnace (2) to bring the pieces to the temperature or temperatures of treatment, transporting the lots of pieces, firstly, to the interior of the furnace (2), and secondly, to the interior of the quenching cell (4), as well as between the furnace and the quenching cell by means of transport means (T), regulating the displacement of the lots of pieces on the transport means (T), along the treatment line (LT) such that the lots of pieces are displaced along said treatment line, locally, at different speed levels (V1, V2 and V3), displacing lots of pieces from the exterior of the furnace (2) to a first region interior of the furnace (R1), called input region, according to a first speed level V1 to ensure the rapid introduction of the charges into the furnace, displacing lots of pieces located in a second region (R2) of the furnace, called central region, disposed downstream from the first region (R1), according to a second speed level V2, less than the speed level V1, the speed level V2 being chosen to ensure the application of the treatment to the pieces in the furnace, and displacing lots of pieces from a third region of the furnace (R3) called the output, located downstream from the second region, to the interior of the quenching cell, according to a third speed level V3, greater than the level V2, the speed level V3 being chosen to ensure the rapid transfer of the lots of pieces between the furnace (2) and the quenching cell (4).

12. A method according to claim 11, and further comprising the steps of:

closing at least the output of the furnace (2) by a non gastight closing door (P2) and insulating the atmosphere of the furnace (2) from the atmosphere of the quenching cell (4) by creating a protection screen, at the output of the furnace (2), at least when the said door (P2) is opened.

13. A method according to claim 11, and further comprising the steps of:

passing the charges (C), immediately before the input into the furnace (2), through a first non heated thermally isolated channel (C1), communicating with the furnace (2), and passing the charges (C) immediately at the output of the furnace (2), through a second non heated isolated channel (C2), also communicating with the furnace (2).

14. A method according to claim 4, and further comprising the steps of:

passing the charges (C), immediately before the input into the furnace (2), through a first non heated thermally isolated channel (C1), communicating with the furnace (2), and passing the charges (C) immediately at the output of the furnace (2), through a second non heated isolated channel (C2), also communicating with the furnace (2).

15. An installation for the implementation of a method, for the thermal treatment of pieces of small dimensions including:

at least one treatment furnace (2) for bringing the pieces to be treated (22) to treatment temperatures, at least one quenching cell (4) located downstream from the furnace (2), the furnace and the quenching cell forming a treatment line (LT), and transport means (T) enabling the displacement of the pieces (22) along the treatment line (LT), the installation comprising a group of trays or baskets (20) for receiving the pieces to be treated (22) into groups in individual charges to constitute distinct lots of pieces forming a volume V of pieces whose height H is substantially less than the other dimensions (L1, L2) of the volume, said transport means (T) being further constituted by several driving devices (DE1, DE2, DE3, DE3' and DE4) which are individually regulated by a regulation means (UC), at at least three different speed levels respectively an input speed level (V1), a treatment speed level (V2) and an output speed level (V3) to divide the treatment line (LT) into sectors (S1, S2 and S3) and ensuring locally, on treatment line, a displacement of the lots of pieces at different speeds level (V1, V2 and V3), said installation further comprising four distinct driving devices (DE1 to DE4).

16. An installation according to claim 15, wherein the driving devices include:

a first driving device (DE1) extending from the input (E) of the installation, upstream from an input gate (P1) of the furnace (2) and above the input gate (P1) to enable the passage of lots of pieces beyond the input gate (P1) at a speed level (V1), a second driving device (DE2) disposed downstream from the first driving device and extending at least to the interior of the furnace (2), the second device (DE2) enabling the treatment of lots of pieces (C) at a speed level (V2), less than the speed level (V1), a third driving device (DE3') located downstream from the second driving device and extending from the interior of the quenching cell (4), the third driving device enabling the output of the lots of pieces from the furnace and their rapid introduction into the quenching cell (4) at a speed level (V3) greater than the preceding speed level (V2) and, a fourth driving device (DE4) disposed downstream from the third driving device and extending from the interior of the channel (C2) at least to the interior of the quenching cell (4), the fourth driving device (DE4) enabling the output of the lots of pieces from the furnace and their rapid introduction into the quenching cell (4) at the speed level (V3).

17. An installation according to claim 15, including two non heated thermally isolated channels (C1 and C2), located respectively between an input gate (P1) of the furnace and an input thereof (2*d*) and between the output (2*c*) of the furnace and an output gate of the furnace (P2).

18. An installation according to claim 16, including two non heated thermally isolated channels (C1 and C2), located respectively between an input gate (P1) of the furnace and an input thereof (2*d*) and between the output (2*c*) of the furnace and an output gate of the furnace (P2).

19. A method for the thermal treatment of pieces of small dimensions, on a treatment line (LT) including at least one furnace (2) and a quenching cell (4), said method comprising the steps:

arranging the pieces to be treated (22) in individual charges (C), in trays or baskets (20), to constitute distinct lots forming a volume V of pieces whose height H is chosen to be substantially less than the other dimensions (L1, L2) of the volume, introducing the lots of pieces in the furnace (2) to bring the said pieces to the temperature or temperatures of treatment, transporting the lots of pieces, firstly to the interior of the furnace (2), and secondly, to the interior of the quenching cell (4), as well as between the furnace and the quenching cell by means of transport means (T), regulating the displacement of the charges (C) on the transport means (T), along the treatment line (LT) such that the charges (C) are displaced along the treatment line, locally, at different speed levels (V1, V2 and V3), passing the lots of pieces, immediately before the input into the furnace (2), through a first non heated thermally isolated channel (C1), communicating with the furnace (2), and passing the lots of pieces, immediately at the output of the furnace (2), through a second non heated isolated channel (C2), also communicating with the furnace (2).

20. An installation for the implementation of a method for thermal treatment of pieces of small dimensions including:

at least one treatment furnace (2) for bringing the pieces to be treated (22) to treatment temperatures, at least one quenching cell (4) located downstream from the furnace (2), the furnace and the quenching cell forming a treatment line (LT), and transport means (T) enabling the displacement of the pieces (22) along the treatment line (LT), wherein said installation comprising a group of trays or baskets (20) adapted to receive the pieces to be treated (22) in a group in an individual charges to constitute distinct lots forming a volume V of pieces whose height H is substantially less than the other dimensions (L1, L2) of the volume, said transport means (T) being further constituted by several driving devices (DE1, DE2, DE3', and DE4) which may be individually regulated by regulation means (UC), at at least three typical different speed levels respectively the input speed level (V1), the treatment speed level (V2) and the output speed level (V3) to divide the treatment line (LT) into sectors (S1, S2 and S3) ensuring locally, on the treatment line, a displacement of the lots of pieces at different speed levels (V1, V2 and V3), said installation including at least:

a first driving device (DE1) extending from the input (E) of the installation, upstream from an input gate (P1) of the furnace (2) and above the input gate (P1) to enable the passage of lots of pieces above the input gate (P1) at a speed level (V1), a second driving device (DE2) disposed downstream from the first driving device and extending at least to the interior of the furnace (2), the second driving device (DE2) enabling the treatment of lots of pieces (C) at a speed level (V2), less than the preceding speed level (V1), and a third driving device (DE3') located downstream from the second driving device and extending to at least the interior of the quenching cell (4), the third driving device enabling the output of the lots of pieces from the furnace and their rapid introduction into the quenching cell (4) at a speed level (V3) greater than the preceding speed level (V2).

21. An installation according to claim 20, including two non heated thermally isolated channels (C1 and C2), located respectively between an input gate (P1) of the furnace and an input thereof (2*d*) and between the output (2*c*) of the furnace and an output gate of the furnace (P2).

22. A method as claimed in claim 4 wherein the protection screen is created by combustion of the treatment gas and another gas.

23. A method as claimed in claim 4 wherein the protection screen is created by establishing an inert gas curtain.

* * * * *

UNITED STATES PATENT AND TRADEMARK OFFICE

CERTIFICATE OF CORRECTION

PATENT NO. : 5,766,382

DATED : June 16, 1998

INVENTOR(S) : Jean-Marie HERTZOG et al.

It is certified that error appears in the above-indentified patent and that said Letters Patent is hereby corrected as shown below:

On the title page, item

[30] In the Foreign Application Priority Data, for "April 13, 1996 [EP] European Pat. Off. ... 95105618"

read "April 13, 1995 [EP] European Pat. Off. ... 95105618"

Signed and Sealed this

Thirteenth Day of October 1998

*Attest:*

Bruce Lehman

BRUCE LEHMAN

*Attesting Officer*

*Commissioner of Patents and Trademarks*